United States Patent [19]

Asano et al.

[11] 4,251,329

[45] Feb. 17, 1981

[54] PROCESS FOR PRODUCING A HIGHLY CORROSION RESISTANT ELECTROPLATED STEEL SHEET

[75] Inventors: Hidejiro Asano; Joji Oka, both of Tokyo; Katushi Saito, Yokohama; Masashi Takasugi, Kawasaki, all of Japan

[73] Assignee: Nippon Steel Corporation, Tokyo, Japan

[21] Appl. No.: 84,299

[22] Filed: Oct. 12, 1979

[30] Foreign Application Priority Data

Oct. 13, 1978 [JP] Japan ..... 53-125925

[51] Int. Cl.[3] ..... C25D 7/06; C25D 3/56

[52] U.S. Cl. ..... 204/27; 204/432; 204/43 T

[58] Field of Search ..... 204/27, 28, 43 T, 43 Z

[56] References Cited

U.S. PATENT DOCUMENTS

| | | | |
|---|---|---|---|
| 2,419,231 | 4/1947 | Schantz | 204/43 Z |

FOREIGN PATENT DOCUMENTS

| | | | |
|---|---|---|---|
| 45-1585 | 1/1970 | Japan . | |
| 49-19979 | 5/1974 | Japan . | |
| 50-29821 | 9/1975 | Japan . | |
| 53-68631 | 6/1978 | Japan . | |
| 7006301 | 11/1970 | Netherlands | 204/43 T |
| 1067942 | 5/1967 | United Kingdom . | |
| 173003 | 8/1965 | U.S.S.R. | 204/43 Z |
| 357267 | 1/1973 | U.S.S.R. | 204/43 T |

OTHER PUBLICATIONS

Proceedings, 9th World Congress on Metal Finishing, Oct. 1976, vol. 76, pp. 1–16.

*Primary Examiner*—T. M. Tufariello

*Attorney, Agent, or Firm*—Cushman, Darby & Cushman

[57] ABSTRACT

Electroplating in an acidic zinc-nickel alloy plating bath containing vanadium ions as a third component provides a plating having a surprisingly high level of corrosion resistance equal to about 10 times that of pure zinc.

12 Claims, 1 Drawing Figure

PROCESS FOR PRODUCING A HIGHLY CORROSION RESISTANT ELECTROPLATED STEEL SHEET

FIELD OF THE INVENTION

This invention relates to a process for producing a highly corrosion resistant electroplated steel sheet.

DESCRIPTION OF THE INVENTION (1) Steels under natural environmental conditions are corroded and worn down by the action of oxygen, water and ions, and various methods of plating steel objects are used to protect them against rust. Two protective plating methods are in wide use: one method uses the sacrificial protection provided by zinc and cadmium (also aluminum and tin under special environments) and the other is plating that makes use of passivation of nickel, chromium, lead and steel. As much as 5 million tons of zinc plated steel sheets are produced annually by hot dipping (galvanizing) and electroplating. If the growth in production continues at the current rate, shortage of the supply of zinc resources is sure to occur in the future. Therefore, in parallel with tapping new zinc resources, the existing resources on the earth must be conserved by reducing the weight of zinc platings without loss of quality. Automobile bodies are subject to pronounced corrosion induced by antifreezing chlorides sprayed on roads in winter, and car manufacturers urgently demand coated steels with higher resistance to corrosion. The most promising means to satisfy the demand is to plate steels with a metal, particularly zinc, that is highly resistant to $Cl^-$. The recent trend in the auto industry is to plate only one side of body panels without reducing their performance. The disadvantage of this technique as far as carmakers are concerned is that the conventional zinc plating undergoes rapid sacrificial corrosion which results in deterioration of the coating on the coated surface (not plated with zinc.). It has therefore been necessary to develop a zinc-plated steel sheet which meets the demand for higher resistance to chloride ions and is characterized by a controlled rate of corrosion.

The life of a zinc-plated steel sheet is determined by the corrosion rate under given environments and the plating thickness. Zinc corroded under natural environmental conditions forms a white corrosion product. The corrosion rate of zinc greatly varies with the denseness, insulating properties and solubility of the corrosion product. For instance, zinc is rapidly corroded in atmosphere containing sulfur dioxide because the corrosion product easily dissolves in water and fails to provide the intended protection. Rapid corrosion in water at high temperatures or in brine is largely due to the formation of a corrosion product that is high in electrical conductivity. Another major reason for accelerated corrosion is the presence of pinholes. All types of corrosion of metals under natural environmental conditions can be explained electrochemically, and a pinhole in a zinc-plated steel sheet penetrating to the steel substrate facilitates cathodic reaction to accelerate the corrosion of zinc in the surrounding area.

As discussed above, the corrosion product and pinholes are two major causes of corrosion of zinc platings, and a number of studies have been reported and patents disclosed on various methods of corrosion protection. Disclosed methods of providing corrosion resistant zinc platings consist of alloying zinc with chromium, nickel, aluminum, magnesium and cobalt and other corrosion resistant metals. Almost all of the disclosed zinc alloy platings are made of binary alloys as illustrated in Japanese Patent Publications Nos. 1585/70 and 29821/75. A ternary alloy plating consisting of zinc-cobalt-molybdenum of the type described in Japanese Patent Publication No. 19979/74 is being produced on a commercial scale. A plating of ternary system has also been reported by, for example, T. Adaniya and M. Ohmura; World Congress of Metal Finishing, 76 (9th.), 1-16 (1976). However, all these conventional zinc alloy platings are only two to three times more corrosion resistant than pure zinc platings when they are tested by the salt spray corrosion test as specified in the Japanese Industrial Standards.

(2) Other prior art references relating to the subject matter of this invention include Japanese Patent Publication No. 19979/74 filed by Toyo Kohan Co., Ltd., Japanese Patent Public Disclosure No. 68631/78 by Kawasaki Steel Corp. and Japanese Patent Publication No. 29821/75 by Nippon Steel Corporation.

These three references relate to ternary Zn-based alloy platings. Japanese Patent Publication No. 19979/74 uses as the alloying additives one or more oxides of molybdenum, tungsten and cobalt and one or more elements or compounds of iron, nickel, tin and lead. Japanese Patent Public Disclosure No. 68631.78 uses one or more elements selected from the group consisting of nickel, cobalt, iron, chromium, molybdenum, cadmium, copper, tin, manganese, magnesium, calcium and beryllium plus aluminum powder. Japanese Patent Publication No. 29821/75 uses two elements selected from the group consisting of cobalt, nickel, magnesium, manganese, bismuth, tin, and iron. So long as the ternary system of each prior art reference contains Ni as an alloying additive, two components (Zn and Ni) are the same as those used in this invention, but the metal or its compound contained as the third component is not vanadium or vanadium containing compounds of this invention. While Japanese Patent Public Disclosure No. 68631/78 gives no specific data on the corrosion resistance of the ternary alloy plating it teaches, the two other references show that their ternary alloy platings are about 3 to 4 times more corrosion resistant than pure zinc platings. In contrast, as accompanying FIG. 1 demonstrates, the Zn-Ni-V ternary alloy plating of this invention is as much as about 10 times more resistant than zinc platings, which bespeaks the inventiveness or superiority of this invention over the prior art zinc alloy platings.

SUMMARY OF THE INVENTION

Therefore, one object of this invention is to provide a process for improving the corrosion resistance of a zinc-based alloy plated steel sheet used for durable consumer goods such as automobiles and appliances as well as construction materials.

Another object of this invention is to provide a zinc-based alloy plating having a surprisingly high level of corrosion resistance equal to about 10 times that of pure zinc plating.

A further object of this invention is to provide a zinc-based alloy plating the corrosion rate of which is about one-tenth that of pure zinc, thus achieving reasonable protection of the steel substrate from corrosion.

These objects and advantages of this invention are accomplished by a process for producing a highly corrosion resistant electroplated steel sheet characterized by performing electroplating in an acidic plating bath with a steel sheet used as the cathode, said bath comprising an aqueous solution containing zinc, nickel and one or more third components selected from the group consisting of vanadium (II), vanadium (III), vanadium (IV) and Vanadium (V) compounds (the figures II, III, IV and V indicating the valence of vanadium).

DETAILED DESCRIPTION OF PREFERRED EMBODIMENTS

Figure 1:
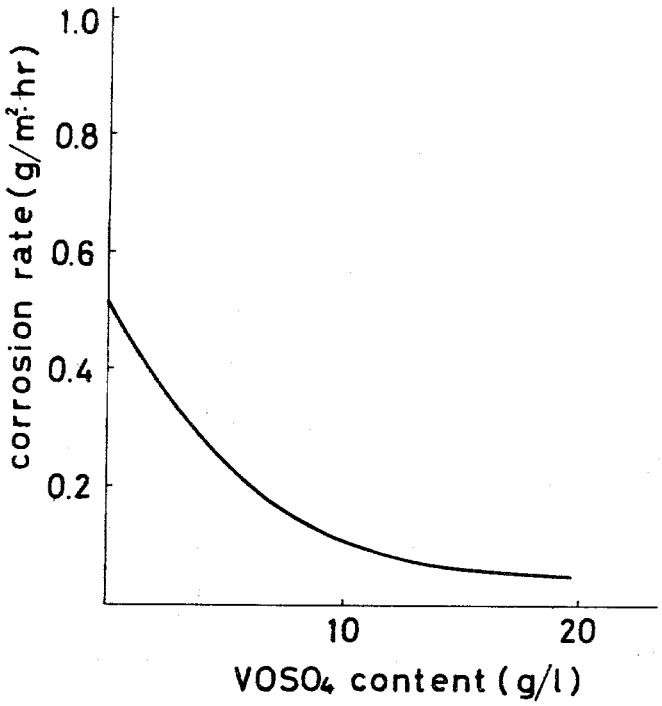
FIG. 1 is a graph indicating the results of salt spray corrosion test on the plating produced from a plating bath comprising zinc sulfate and nickel sulfate plus vanadyl sulfate.

The process of this invention is now described by reference to FIG. 1 which shows the results of salt spray corrosion test on the plating produced from a plating bath wherein vanadyl sulfate was added to a mixture of 200 g/l of zinc sulfate and 200 g/l of nickel sulfate held at a pH of 3. The corrosion rate in terms of the corroded weight per hour ($g/m^2.hr$) was determined by dividing the plating weight by the time required for the formation of red rust. The corrosion rate of pure zinc was 1 $g/m^2.hr$. As is clearly seen from FIG. 1, the addition of vanadium ion has marked effects in increasing the corrosion resistance of a Zn-Ni alloy. The corrosion rate of the binary Zn-V and Zn-Ni alloys cannot be made slower than the range of from 0.3 to 0.5 $g/m^2.hr$. Only vanadium ion is effective as an ion to be incorporated in Zn-Ni alloy. Other ions such as copper, tin, iron, cobalt and molybdenum ions have little effect of addition or even reduce the corrosion resistance of the binary alloy to which they are added.

The plating produced by the process of this invention comprises a Zn-Ni intermetallic compound or a mixed phase thereof with zinc and/or nickel which has dispersed therein vanadium oxide which is found to be non-crystalline by X-ray diffractometry. The presence of such oxide effectively inhibits the corrosion of the Zn-Ni alloy and provides a plating having high resistance to white rust without requiring a special treatment. The plating also has the ability to provide cathodic protection for the steel substrate.

A steel sheet electroplated according to the process of this invention performs well when coated with a paint. The reasons are retarded undercutting corrosion due to low corrosion rate and an intimate adhesion with the coating because of the presence of vanadium oxide. It is to be understood that such electroplated steel sheet may advantageously be subjected to an after-treatment with chromate, phosphate and other chemicals conventionally employed in zinc plating. The chromate treatment is effective in further inhibiting the development of white rust. If prior to coating with a paint, the plated steel sheet undergoes such after-treatment, not only an intimate adhesion with the coating is provided but the possibility of a blister to develop from a pinhole, scratch and other defects in the coating can be eliminated.

A specific process of this invention is hereunder described in detail. Any conventional type of Zn-Ni plating bath can be employed; for instance, it consists of zinc and nickel sulfates, zinc and nickel chlorides, zinc and nickel sulfamates, and zinc and nickel pyrophosphates. The nickel to zinc proportion is in the range of from 0.1 to 3 mols of Ni per mol of Zn. Vanadium incorporated in the bath exhibits its effect to the fullest when the nickel to zinc ratio is from 0.5 to 2.5 mols of Ni per mol of Zn.

Exemplary vanadium compounds to be added to the bath as the third component include a vanadium (II) compound selected from the group consisting of vanadium (II) sulfate ($VSO_4$), vanadium (II) chloride ($VCl_2$), vanadium acetate, and vanadium sulfamate; a vanadium (III) compound selected from the group consisting of vanadium (III) sulfate, vanadium trichloride and vanadium (III) phosphate; a vanadium (IV) compound selected from the group consisting of vanadium oxydichloride (vanadyl chloride), vanadium (IV) oxysulfate (vanadyl sulfate) and vanadium tetrachloride; a vanadium (V) compound, i.e. a vanadate. Vanadium oxides (VO, $V_2O_3$, $VO_2$ and $V_2O_5$) may optionally be used. Vanadium is added in an amount between 0.001 and 0.5 mols per mol of the sum of zinc and nickel. If the vanadium content is less than 0.001 mol, the vanadium content in plate is too small and the resulting plate is low in corrosion resistance. If the content is more than 0.5 mols, the corrosion rate of the plating is considerably decreased but then the coulombic efficiency is decreased the plating deposited is passivated, and the resulting plating no longer has the ability to provide cathodic protection for the steel substrate. The vanadium content which is sufficient to cause dissolution of the plating necessary for providing minimum required cathodic protection is between 0.01 and 0.5 mols.

In order to hold the pH of the plating bath at a constant level, the bath may contain a suitable amount of a pH buffer selected from the group consisting of a phosphate, borate or phthalate. A preferred pH of the bath is between 2 and 4. At a pH lower than 2, the deposition of zinc and nickel predominates over that of the intended plating, with co-deposition of vanadium being depressed. At a pH higher than 4, the coulombic efficiency tends to decrease to provide a plating of a coarse appearance. The pH control for the bath is carried out with an acid and a metal oxide. The bath temperature is not a critical factor in this invention, and the range of 20° to 60° C. conventionally used for zinc plating is suitable.

The anode may be a soluble metal such as zinc or nickel, or an insoluble one such as a titanium plate plated with a noble metal or lead, or an oxide electrode such as magnetite and ferrite. The current density may be selected from the range conventionally used for zinc plating. At higher current density, the flow rate of the electrolyte must be increased to prevent the plating surface from becoming coarse.

The process of this invention is now described in greater detail by reference to the following examples which are given here for illustrative purposes only and are by no means intended to limit the scope of the invention.

EXAMPLE 1

Four alloy plating baths were prepared by dissolving 200 g of zinc sulfate ($ZnSO_4.7H_2O$) and 200 g of nickel sulfate ($NiSO_4.6H_2O$) in water to make one liter. Vanadyl sulfate ($VOSO_4.6H_2O$) was added to these baths in amounts of 1 g, 5 g, 10 g and 20 g, respectively. Sulfuric acid was used to adjust the pH of each bath to 3. A cold rolled steel sheet was degreased with alkali, washed with hot water, washed with water, cleaned with 10% hydrochloric acid, washed again with water, and dipped in each bath for electroplating. The bath temperature was between 45° and 55° C.; the electrode spacing was 50 mm; the anode was pure zinc (purity: 99.9%); the electrolyte was pumped for circulation; and the current density was 20 A/dm$^2$. The electroplating was continued until the plating weight was 20 g/m$^2$. The resultant platings were black. Each of them was subjected to the salt spray test as specified in JIS Z 2371. The test results are graphed in FIG. 1. Another panel in each plating was made scratches that penetrated to the steel substrate with stylus and subjected to the salt spray test which indicated that no red rust developed from the scratch to affect the surrounding area.

Each plating was coated with a commercial melamine alkyd resin paint to a thickness of 25 microns, baked at 120° C. for 20 minutes, and tested for the adhesion and corrosion resistance. The adhesion testing consisted of the cross hatch test, impact test by du Pont tester and bend test (4T) according to JIS G 3312 "Precoated galvanized steel sheet", as well as the Erichsen test of JIS B 7777 wherein a plunger was forced 10 mm deep into the sample. The test results were: the resin coating was separated almost completely from platings of pure zinc and zinc-nickel alloy prepared as controls, but visual inspection of the electroplate of this invention did not indicate any such effect. To evaluate the corrosion resistance of each sample, a single-edged razor was used to make a scratch in the sample that penetrated to the steel substrate, the cut edge was sealed and the sample was subjected to a 10-day salt spray test wherein the width of the deteriorated area as measured from the scratch was read on a measuring scale. The results were more than 20 mm for pure zinc, 5 mm for zinc-nickel alloy and less than 1 mm for the electroplate of this invention.

EXAMPLE 2

Two plating baths were prepared, both comprising one liter of an aqueous solution of 200 g of zinc chloride and 200 g of nickel chloride and adjusted to a pH of 3 with hydrochloric acid; one of them contained 20 g of vanadium chloride ($VCl_2$) and the other contained 20 g of ammonium vanadate ($NH_4VO_3$). The procedure of Example 1 was repeated to clean a cold rolled steel sheet prior to electroplating. The plating produced from each bath in a plating weight of 20 g/m$^2$ was subjected to a 240-hour salt spray corrosion test which produced only specks of red rust.

What is claimed is:

1. A process for producing a highly corrosion resistant electroplated steel sheet characterized by performing electroplating in an acidic plating bath with a steel sheet used as the cathode, said bath comprising an aqueous solution containing zinc, nickel and one or more third components selected from the group consisting of vanadium (II), vanadium (III), vanadium (IV) and vanadium (V) compounds (the FIGS. II, III, IV and V indicating the valence of vanadium), the content of vanadium being between 0.001 and 0.5 mols per mol of the sum of zinc and nickel.

2. A process according to claim 1 wherein the proportion of nickel and zinc is between 0.1 and 3.0 mols of nickel per mol of zinc.

3. A process according to claim 1 wherein the vanadium compound incorporated as the third component comprises a vanadium (II) compound selected from the group consisting of vanadium (II) sulfate ($VSO_4$), vanadium (II) chloride ($VCl_2$), vanadium acetate and vanadium sulfamate; a vanadium (III) compound selected from the group consisting of vanadium (III) sulfate, vanadium trichloride and vanadium (III) phosphate; a vanadium (IV) compound selected from the group consisting of vanadium oxydichloride (vanadyl chloride), vanadium (IV) oxysulfate (vanadyl sulfate) and vanadium tetrachloride; or a vanadium (V) compound.

4. A process according to claim 1 wherein the plating bath contains a pH buffer selected from the group consisting of a phosphate, borate and a phthalate.

5. A process according to claim 1 wherein the pH of the plating bath is between 2 and 4.

6. A process according to claim 1 wherein the proportion of nickel and zinc is between 0.5 and 2.5 mols of nickel per mol of zinc.

7. A process according to claim 6 wherein the content of vanadium is between 0.01 and 0.5 mols per mol of the sum of zinc and nickel.

8. A process according to claim 7 wherein the pH of the plating bath is between 2 and 4.

9. A process according to claim 1 wherein the proportion of nickel and zinc is between 0.1 and 3.0 mols of nickel per mol of zinc and the content of vanadium is between 0.001 and 0.5 mols per mol of the sum of zinc and nickel.

10. A process according to claim 9 wherein the pH of the plating bath is between 2 and 4.

11. A process according to claim 1 wherein the content of vanadium added as the third component is between 0.01 and 0.5 mols per mol of the sum of zinc and nickel.

12. A process according to claim 1 wherein the vanadium compound comprises a vanadium oxide selected from the group consisting of VO, $V_2O_3$, $VO_2$ and $V_2O_5$.

* * * * *